US012082659B2

(12) United States Patent
Lu

(10) Patent No.: US 12,082,659 B2
(45) Date of Patent: Sep. 10, 2024

(54) MAGNETICALLY-ATTRACTED BUCKLE AND WEARABLE DEVICE

(71) Applicant: Shenzhen Yafei Industrial Technology Co., Ltd., Shenzhen (CN)

(72) Inventor: Haibing Lu, Shenzhen (CN)

( * ) Notice: Subject to any disclaimer, the term of this patent is extended or adjusted under 35 U.S.C. 154(b) by 0 days.

(21) Appl. No.: 18/321,951

(22) Filed: May 23, 2023

(65) Prior Publication Data

US 2023/0363498 A1 Nov. 16, 2023

(30) Foreign Application Priority Data

May 4, 2023 (CN) ..... 202321036321.8

(51) Int. Cl.
*A44B 11/26* (2006.01)
*A44B 11/00* (2006.01)

(52) U.S. Cl.
CPC ..... *A44B 11/266* (2013.01); *A44B 11/001* (2013.01); *A44B 11/006* (2013.01); *A44D 2203/00* (2013.01)

(58) Field of Classification Search
CPC ..... A44B 11/26; A44B 11/001; A44B 11/006; A44B 11/258; A44B 11/243; A44B 11/246; Y10T 24/4782; Y10T 24/32; A44D 2203/00
See application file for complete search history.

(56) References Cited

U.S. PATENT DOCUMENTS 4,527,311 A * 7/1985 Aoki ..... A44C 5/2042 24/303
7,073,232 B1 * 7/2006 Fuhrman ..... A44C 5/2042 24/303
7,334,433 B1 * 2/2008 Fuhrman ..... A44C 5/2076 63/3
7,849,569 B2 * 12/2010 Cope ..... A44C 5/2042 63/3.1
8,209,824 B2 * 7/2012 Fuhtman ..... A44C 5/2076 63/3.1
2015/0289607 A1 10/2015 Lee et al.
2016/0081440 A1 3/2016 Baek
2018/0103906 A1 4/2018 Gandhi et al.

* cited by examiner

*Primary Examiner* — Robert Sandy

(57) ABSTRACT

The present invention has disclosed a magnetically-attracted buckle and a wearable device, which pertain to the technical field of strip-connecting structures. The present invention enables the first buckle and the second buckle to connect with each other by one hand, and the second magnetically-attracted member inserted into the hollow hampers the second buckle from being pulled out of the first buckle, avoiding the second buckle from easily separating from the first buckle.

11 Claims, 6 Drawing Sheets

MAGNETICALLY-ATTRACTED BUCKLE AND WEARABLE DEVICE

FIELD OF THE INVENTION

The present invention pertains to the technical field of strip-connecting structures, more specifically, relates to a magnetically-attracted buckle and a wearable device.

BACKGROUND OF THE INVENTION

A connection structure between two belts is typically needed to connect a wearable device together, so as to wear the wearable device on a user's wrist. At present, such structure fitting in with belts includes a hook buckle, a concealed buckle, a butterfly buckle, a belt snap-fastener, a folding safety buckle, a folding buckle, a pin buckle and magnetically-attracted buckle.

The China utility model patent published as CN216165681U on Apr. 5, 2022 has disclosed a folding magnetically-attracted watch-buckled structure. Fundamentally, the watch-buckled structure is a magnetically-attracted buckle, which has the defect that, when the two belts are connected, one end of the back-pressing baffle passes through the containing hole from bottom to top and folds up on the outer surface of the middle lapped butt, and the back-pressing baffle is attracted by and fixed with the middle lapped butt by means of a magnet. Such handling is cumbersome, and due to the attractive effect of the magnet, the back-pressing baffle flips over and attracts the magnet without having passed through the containing hole, so it is more inconvenient to handle it by one hand.

SUMMARY OF THE INVENTION

1. The Technical Problem to be Solved

In view of the problem that it is inconvenient to handle the existing magnetically-attracted belt connection by one hand, the present invention provides a magnetically-attracted buckle and a wearable device.

2. Technical Solution

In order to solve the above problem, the present invention innovates the following technical solution.

A magnetically-attracted buckle includes a first buckle and a second buckle that magnetically attract each other, said first buckle includes a buckle seat and a first magnetically-attracted member, a first installing position and a second installing position are arranged on the two opposite sides of said buckle seat, respectively, said first installing position and said second installing position communicate with each other through a hollow, said first magnetically-attracted member is arranged at said first installing position; said second buckle includes a buckle base, a raised second magnetically-attracted member is arranged on one side of said buckle base close to said second installing position; in a buckling state, said buckle base buckles on said second installing position, said second magnetically-attracted member attracts said first magnetically-attracted member, passing through said hollow. During use, just one hand enables said first buckle directly to buckle on said second buckle. As said second magnetically-attracted member raised in the buckling state attracts said first magnetically-attracted member, passing through said hollow, on the one hand, the two are combined to each other through magnetic attraction, and on the other hand, said second magnetically-attracted member is jammed in said hollow, so it can avoid said second buckle from being easily pulled out of said first buckle.

Furthermore, said first buckle further includes two buttons facing each other, said first magnetically-attracted member and said buttons are successively arranged at the first installing position from outside to inside, a thorough hole is arranged on the side wall of said first installing position, said buttons are set expandably and shrinkably in said thorough hole; a couple of jamming-buckling parts fitting with each other are arranged on said buttons and said second magnetically-attracted member; the exterior length and/or exterior width of said button is greater than the interior length and/or interior width of said hollow; in a buckling state, said buttons and said second magnetically-attracted member buckle on each other by means of said couple of jamming-buckling parts. Press said buttons, said couple of jamming-buckling parts arranged on said buttons and said second magnetically-attracted member separate from each other, then the buckle is released. Said couple of jamming-buckling parts arranged on said buttons and said second magnetically-attracted member, instead of strong force, can avoid said second buckle from being pulled out.

Furthermore, said first magnetically-attracted member includes a carrying piece, a first installing groove is arranged on one side of said carrying piece far away from said second buckle; said second magnetically-attracted member includes a second installing groove, the opening of which is positioned at one side far away from said first buckle, magnets are arranged inside each of said first installing groove and said second installing groove. As both magnets are placed in the grooves, and the opening directions of said first installing groove and said second installing groove are opposite to each other, the magnets arranged on said first buckle and said second buckle will not be in direct contact with each other, so such structure can avoid them from falling off under their mutual attraction.

Furthermore, one side of said first installing groove close to said second buckle protrudes from the side wall of said carrying peace, so as to shorten the magnetically-attracted distance between said first magnetically-attracted member and said second magnetically-attracted member. Moreover, compared with a first installing groove not protruding from the side wall of said carrying peace, the first installing groove protruding from the side wall of said carrying peace can hold a thicker magnet, or the thickness of said carrying piece narrows in conditions of not changing the thickness of the magnet, so as to reduce the weight of the entire buckle, therefore, it is easy to process the metal carrying piece with the narrowed thickness, reducing production costs.

Furthermore, an off-position hole is set at the middle of said buttons, and in a buckling state, said second magnetically-attracted member attracts said first magnetically-attracted member, passing through said off-position hole. Such structure can shorten the magnetically-attracted distance between said second magnetically-attracted member and said first magnetically-attracted member.

Furthermore, a first sinking groove is set inside said first installing position, a second sinking groove is set inside said first sinking groove, said carrying piece is set in said second sinking groove, and orientated by the side wall of said second sinking groove.

Furthermore, a positioning block is set on one side of said second sinking groove, a positioning gap fitting in with said positioning block is set on said carrying piece. The magnets arranged on said second magnetically-attracted member and said first magnetically-attracted member face each other through positioning, enabling both to exert their attraction.

Furthermore, a first decoration piece is set inside said first sinking groove. Said first decoration piece can plug said first sinking groove to prevent the magnet from falling off.

Furthermore, a second decoration piece is set on one side of said buckle base far away from said first buckle. Said second decoration piece can prevent the magnet arranged inside said second installing groove from falling off.

The present invention further provides a wearable device, including a first belt, a second belt and any one of the magnetically-attracted buckles described above, said first belt is connected with said buckle seat, said second belt is connected with said buckle base, and said first belt and said second belt are connected with each other by means of said magnetically-attracted buckle.

3. Beneficial Effects

Compared with the prior art, the present invention has the following the beneficial effects.

(1) In the present invention, the raised second magnetically-attracted member on the second buckle is inserted into the hollow, and attracts the first magnetically-attracted member on the first buckle, so as to enable the first buckle and the second buckle to connect with each other by one hand, moreover, the second magnetically-attracted member inserted into the hollow hampers the second buckle from being pulled out of the first buckle, avoiding the second buckle from being easily pulled out of the first buckle.

(2) In the present invention, the buttons are set expandably and shrinkably on the buckle seat, and the couple of jamming-buckling parts fitting with each other are arranged on the buttons and the second magnetically-attracted member, so as to enable the buttons to buckle on the second magnetically-attracted member in the bucking state, avoiding the second buckle from being pulled out under strong force.

Where, 1—buckle seat, 2—first magnetically-attracted member, 3—first installing position, 4—second installing position, 5—hollow, 6—buckle base, 7—second magnetically-attracted member, 8—button, 9—thorough hole, 10—carrying piece, 11—first installing groove, 12—second installing groove, 13—magnet, 14—off-position hole, 15—first sinking groove, 16—second sinking groove, 17—positioning block, 18—positioning gap, 19—first decoration piece, 20—second decoration piece, 21—first belt, 22—second belt.

DETAILED DESCRIPTION OF SOME EMBODIMENTS

We shall describe the present invention in detail in combination with the drawings as follows.

Embodiment 1

Figure 1:
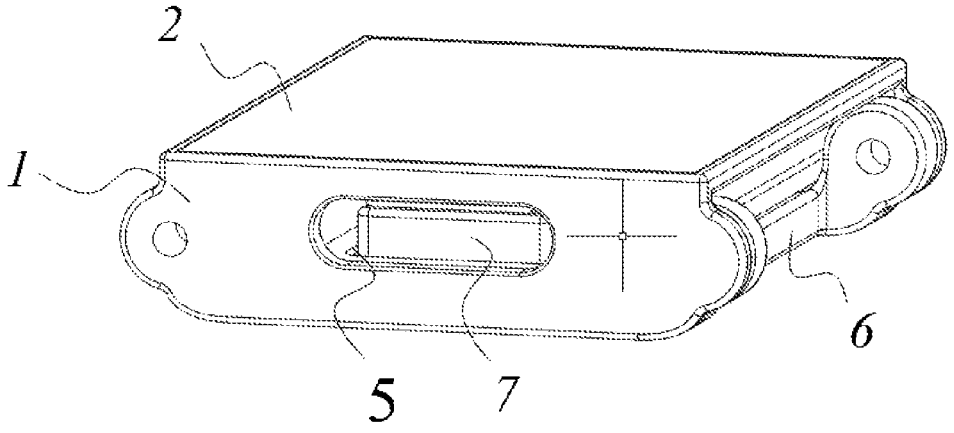
FIG. 1 shows a buckling state view of the magnetically-attracted buckle in embodiment 1.
Figure 2:
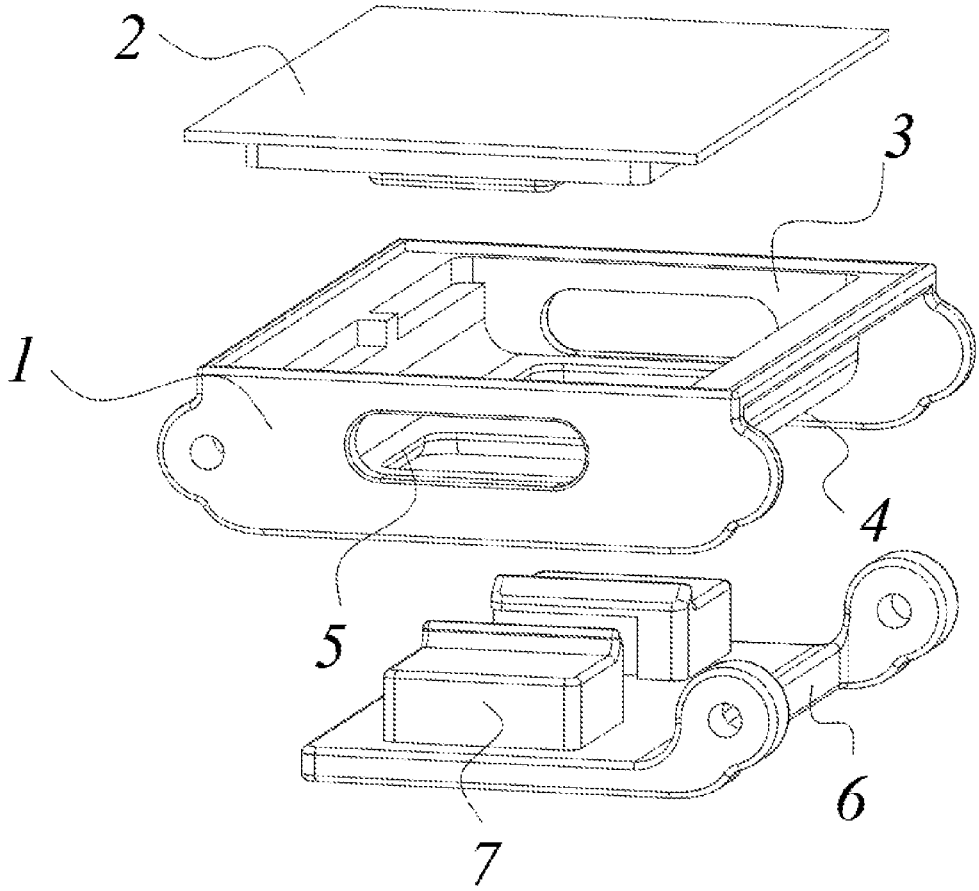
FIG. 2 shows an explosion view of the magnetically-attracted buckle in embodiment 1.

As shown in FIGS. 1-2, a magnetically-attracted buckle includes a first buckle and a second buckle that magnetically attract each other, the first buckle includes the buckle seat 1 and the first magnetically-attracted member 2, the first installing position 3 and the second installing position 4 are arranged on the two opposite sides of the buckle seat, respectively, the first installing position 3 and the second installing position 4 communicate with each other through the hollow 5, the first magnetically-attracted member 2 is arranged at the first installing position 3; the second buckle includes the buckle base 6, the raised second magnetically-attracted member 7 is arranged on one side of the buckle base 6 close to the second installing position 4; in a buckling state, the buckle base 6 buckles on the second installing position 4, the second magnetically-attracted member 7 attracts the first magnetically-attracted member 2, passing through the hollow 5. During use, just one hand enables the first buckle directly to buckle on the second buckle. As the second magnetically-attracted member 7 raised in the buckling state attracts the first magnetically-attracted member 2, passing through the hollow 5, on the one hand, the two are combined to each other through magnetic attraction, and on the other hand, the second magnetically-attracted member 7 is jammed in the hollow 5, so it can avoid the second buckle from being easily pulled out of the first buckle in the horizontal direction shown in FIG. 1. When the first buckle separates from the second buckle, the outer walls of the both sides of the buckle seat 1 can be pinched to be lifted up just by one hand, when the buckle is used together with the belts, the buckle seat 1 can be lifted up by the forefinger and the thumb with the assistance of the other fingers pressing on the belt connected to the buckle base 6, thereby separating the first belt from the second belt. The structure of arranging the buckle seat 1 on the top and buckle base 6 on the bottom can also make the appearance of the entire magnetically-attracted buckle more concise.

Embodiment 2

Figure 3:
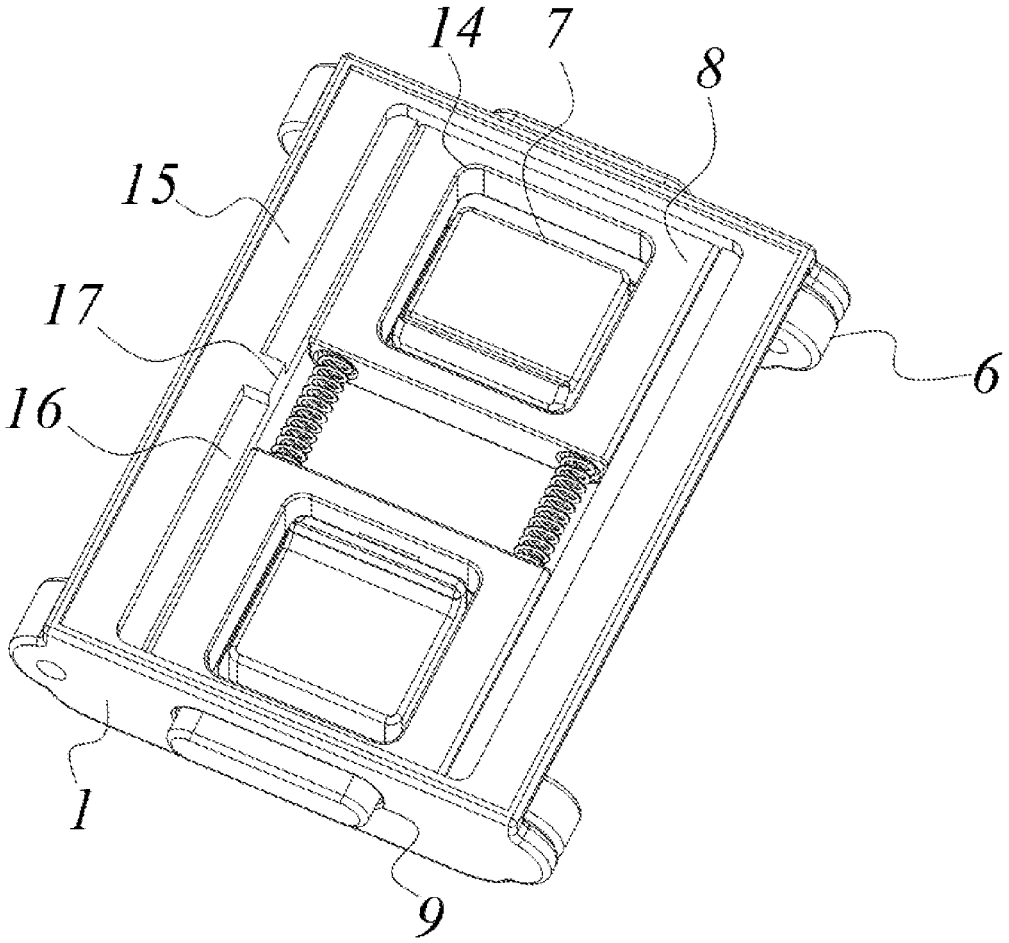
FIG. 3 shows a structure view of assembling the button, the buckle base and the buckle seat of the magnetically-attracted buckle in embodiment 2.
Figure 4:
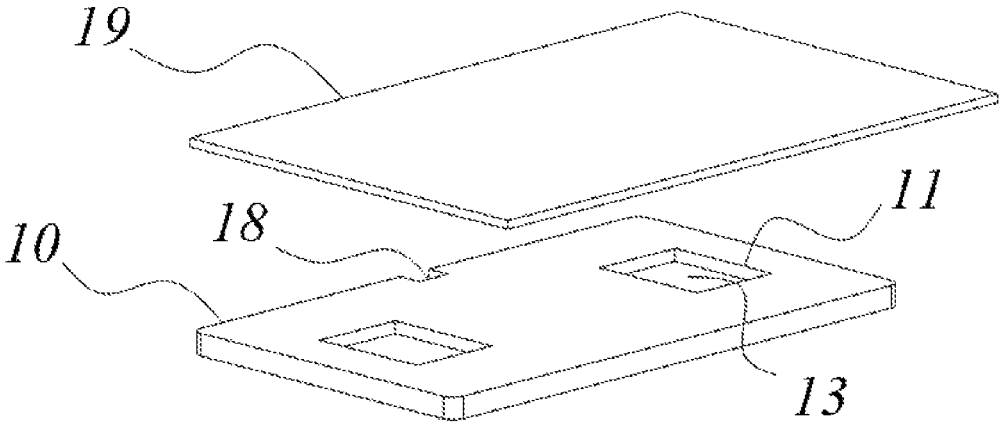
FIG. 4 shows a structure view of the first magnetically-attracted member and the first decoration piece of the magnetically-attracted buckle in embodiment 2.
Figure 5:
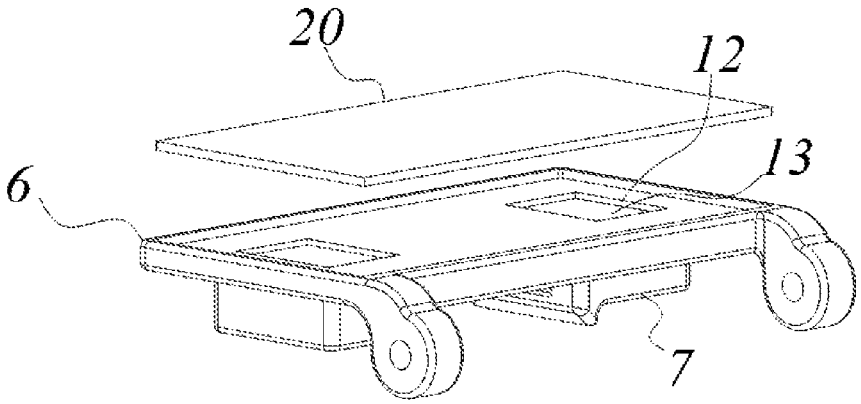
FIG. 5 shows a structure view of the second buckle of the magnetically-attracted buckle in embodiment 2.

As shown in FIGS. 3-5, this embodiment is different from embodiment 1 in that, the first buckle further includes two buttons 8 facing each other, the first magnetically-attracted member 2 and the buttons 8 are successively arranged at the first installing position 3 from outside to inside, the thorough hole 9 is arranged on the side wall of the first installing position 3, the buttons 8 are set expandably and shrinkably in the thorough hole; a couple of jamming-buckling parts fitting with each other are arranged on the buttons 8 and the second magnetically-attracted member 7; the exterior length and/or exterior width of the button 8 is greater than the interior length and/or interior width of the hollow 5, such structure can avoid the buttons 8 from disengaging from the hollow 5; in a buckling state, the buttons 8 and the second magnetically-attracted member 7 buckle on each other by means of the couple of jamming-buckling parts. Press the buttons 8, the couple of jamming-buckling parts arranged on the buttons 8 and the second magnetically-attracted member 7 separate from each other, then the buckle is released. The couple of jamming-buckling parts arranged on the buttons 8 and the second magnetically-attracted member 7, instead of strong force, can avoid the second buckle from being pulled out. A spring may be set between the two buttons 8 to achieve an expandable and shrinkable arrangement, specifically, pairs of spring holes are arranged on the outer wall of the two buttons 8 facing each other, and one spring is installed between each pair of spring holes. The couple of jamming-buckling parts include a jamming hook arranged on the buttons and an in-jammed groove arranged on the second magnetically-attracted member 7, in a buckling state, the jamming hook jams in the in groove, press the buttons 8, then the jamming hook disengages from the in-jammed groove.

The first magnetically-attracted member 2 includes the carrying piece 10, the first installing groove 11 is arranged on one side of the carrying piece 10 far away from the second buckle; the second magnetically-attracted member 7 includes the second installing groove 12, the opening of which is positioned at one side far away from the first buckle, the magnets 13 are arranged inside each of the first installing groove 11 and the second installing groove 12. As both magnets are placed in the grooves, and the opening directions of the first installing groove 11 and the second installing groove 12 are opposite to each other, the magnets arranged on the first buckle and the second buckle will not be in direct contact with each other, so such structure can avoid them from falling off under their mutual attraction.

One side of the first installing groove 11 close to the second buckle protrudes from the side wall of the carrying peace 10, so as to shorten the magnetically-attracted distance between the first magnetically-attracted member 2 and the second magnetically-attracted member 7. Moreover, compared with a first installing groove 11 not protruding from the side wall of the carrying peace 10, the first installing groove 11 protruding from the side wall of the carrying peace 10 can hold a thicker magnet 13, or the thickness of the carrying piece 10 narrows in conditions of not changing the thickness of the magnet 13, so as to reduce the weight of the entire buckle, therefore, it is easy to process the metal carrying piece 10 with the narrowed thickness, reducing production costs. Similarly, installing a magnet in the second installing groove for the raised second magnetically-attracted member 7 also enables the thickness of the buckle base 6 to narrow, so as to reduce the weight of the entire buckle, therefore, it is easy to process the metal carrying piece 10 with the narrowed thickness, reducing production costs.

The off-position hole 14 is set at the middle of the button 8, and in a buckling state, the second magnetically-attracted member 7 attracts the first magnetically-attracted member 2, passing through the off-position hole 14. Such structure can shorten the magnetically-attracted distance between the second magnetically-attracted member 7 and the first magnetically-attracted member 2.

The first sinking groove 15 is set inside the first installing position 3, the second sinking groove 16 is set inside the first sinking groove 15, the carrying piece 10 is set in the second sinking groove 16, and orientated by the side wall of the second sinking groove 16.

The positioning block 17 is set on one side of the second sinking groove 16, the positioning gap 18 fitting in with the positioning block 17 is set on the carrying piece 10. The magnets arranged on the second magnetically-attracted member 7 and the first magnetically-attracted member 2 face each other through positioning, enabling both to exert their attraction.

The first decoration piece 19 is set inside the first sinking groove 15. The first decoration piece 19 not only can plug the first sinking groove 15 to prevent the magnet 13 from falling off, but also serves as a decorating role.

The second decoration piece 20 is set on one side of the buckle base 6 far away from the first buckle. The second decoration piece 20 not only can prevent the magnet 13 arranged inside the second installing groove 12 from falling off, but also serves as a decorating role.

Figure 6:
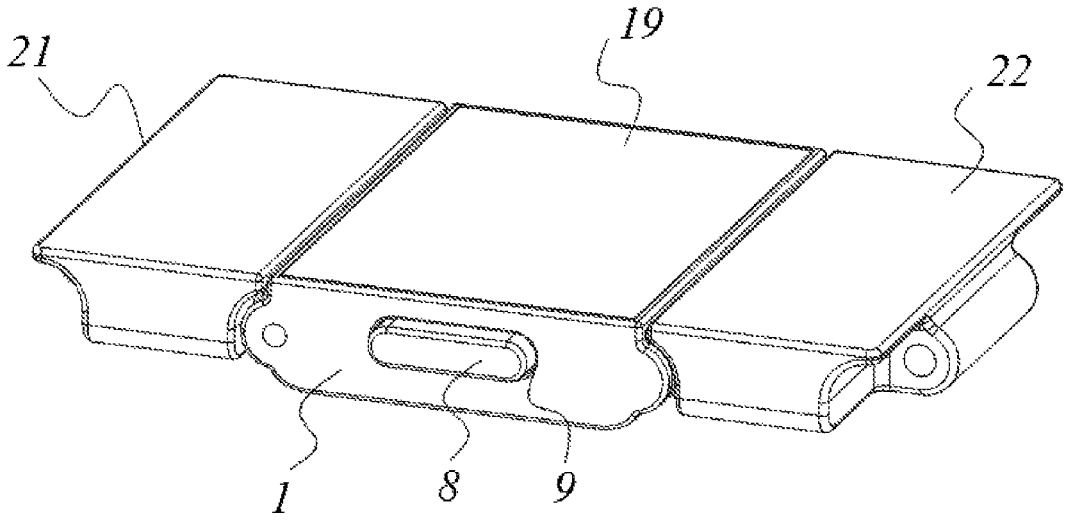
FIG. 6 shows a local structure view of the wearable device.

As shown in FIG. 6, the present invention further provides the wearable device, including the first belt 21, the second belt 22 and any one of the magnetically-attracted buckles described above, the first belt 21 is connected with the buckle seat 1, the second belt 22 is connected with the buckle base 6, and the first belt 21 and the second belt 22 are connected with each other by means of the magnetically-attracted buckle. The wearable device includes, but is not limited to, a smart watch, a smart bracelet, a mobile device, a multimedia player, a gaming device, and other wearable or portable electronic devices. Taking a smart watch as an embodiment, one end of the first belt 21 is far away from the buckle seat 1 and one end of the buckle base 6 far away from the second belt 22 are jointly connected to the dial of the smart watch.

The forementioned embodiments are only used to describe the preferred embodiment of the present invention, not pose a limitation on the scope of the present invention, without departing from the essence of the present invention, all kinds of deformations and improvements to the technical solution of the present invention made by a person skilled in the art shall fall within the protection scope claimed in the present invention.

What is claimed is:

1. A magnetically-attracted buckle comprising a first buckle and a second buckle that magnetically attract each other, wherein said first buckle includes a buckle seat and a first magnetically-attracted member, a first installing position and a second installing position are arranged on two opposite sides of said buckle seat, respectively, said first installing position and said second installing position communicate with each other through a hollow, said first magnetically-attracted member is arranged at said first installing position;

said second buckle includes a buckle base, a raised second magnetically-attracted member is arranged on one side of said buckle base close to said second installing position;

in a buckling state, said buckle base buckles on said second installing position, said second magnetically-attracted member attracts said first magnetically-attracted member, passing through said hollow.

2. The magnetically-attracted buckle according to claim 1, wherein said first buckle further includes two buttons facing each other, said first magnetically-attracted member and said buttons are successively arranged at the first installing position from outside to inside, a through hole is arranged on a side wall of said first installing position, said buttons are set retractably in said through hole; the exterior length and/or exterior width of said button is greater than the interior length and/or interior width of said hollow.

3. The magnetically-attracted buckle according to claim 2, wherein an off-position hole is set at the middle of said buttons, and in a buckling state, said second magnetically-attracted member attracts said first magnetically-attracted member, passing through said off-position hole.

4. The magnetically-attracted buckle according to claim 2, wherein said first magnetically-attracted member includes a carrying piece, a first installing groove is arranged on one side of said carrying piece far away from said second buckle; said second magnetically-attracted member includes a second installing groove, an opening of which is positioned at one side far away from said first buckle, magnets are arranged inside each of said first installing groove and said second installing groove.

5. The magnetically-attracted buckle according to claim 1, wherein said first magnetically-attracted member includes a carrying piece, a first installing groove is arranged on one side of said carrying piece far away from said second buckle; said second magnetically-attracted member includes a second installing groove, an opening of which is positioned at one side far away from said first buckle, magnets are arranged inside each of said first installing groove and said second installing groove.

6. The magnetically-attracted buckle according to claim 5, wherein one side of said first installing groove close to said second buckle protrudes from a side wall of said carrying peace, so as to shorten a magnetically-attracted distance between said first magnetically-attracted member and said second magnetically-attracted member.

7. The magnetically-attracted buckle according to claim 5, wherein a first sinking groove is set inside said first installing position, a second sinking groove is set inside said first sinking groove, said carrying piece is set in said second sinking groove, and orientated by a side wall of said second sinking groove.

8. The magnetically-attracted buckle according to claim 7, wherein a positioning block is set on one side of said second sinking groove, a positioning gap fitting in with said positioning block is set on said carrying piece.

9. The magnetically-attracted buckle according to claim 7, wherein a first decoration piece is set inside said first sinking groove.

10. The magnetically-attracted buckle according to claim 5, wherein a second decoration piece is set on one side of said buckle base far away from said first buckle.

11. A wearable device, comprising a first belt, a second belt and a magnetically-attracted buckle according to claim 1, wherein said first belt is connected with said buckle seat, said second belt is connected with said buckle base, and said first belt and said second belt are connected with each other by means of said magnetically-attracted buckle.

* * * * *